US006286827B1

(12) United States Patent
Meetze, Jr. et al.

(10) Patent No.: US 6,286,827 B1
(45) Date of Patent: Sep. 11, 2001

(54) HIGH CAPACITY AUTOMATIC SHEET INPUT SYSTEM FOR A REPRODUCTION APPARATUS

(75) Inventors: Murray O. Meetze, Jr., Rochester; John D. Gramlich, Webster, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/442,661

(22) Filed: Nov. 18, 1999

(51) Int. Cl.[7] ..... B65H 1/14

(52) U.S. Cl. ..... 271/162; 271/147; 271/157; 206/556

(58) Field of Search ..... 271/145, 147, 271/148, 152–155, 157, 162–163; 221/198; 206/556

(56) References Cited

U.S. PATENT DOCUMENTS

| | | | | |
|---|---|---|---|---|
| 3,758,105 | * | 9/1973 | Okamoto | 271/61 |
| 4,436,406 | | 3/1984 | Murasaki et al. | 355/3 SH |
| 4,504,053 | * | 3/1985 | Shiozawa | 271/157 |
| 4,556,210 | | 12/1985 | George | 271/157 |
| 4,718,658 | | 1/1988 | Hirose et al. | 271/258 |
| 4,750,729 | * | 6/1988 | Kanoto et al. | 271/162 |
| 4,770,301 | | 9/1988 | Nagel | 206/556 |
| 4,802,586 | | 2/1989 | George | 206/556 |
| 4,830,354 | | 5/1989 | Penson | 271/147 |
| 4,946,157 | * | 8/1990 | Gunther | 271/163 |
| 5,152,520 | | 10/1992 | Farrell | 271/10 |
| 5,219,158 | * | 6/1993 | Kilian et al. | 271/145 |
| 5,228,678 | * | 7/1993 | Matsuda et al. | 271/145 |
| 5,328,167 | | 7/1994 | Frank | 271/241 |
| 5,980,676 | | 11/1999 | Meetze | 156/216 |

FOREIGN PATENT DOCUMENTS 0 547 788 B1 6/1993 (EP) .

* cited by examiner

*Primary Examiner*—Christopher P. Ellis
*Assistant Examiner*—Mark A. Deuble

(57) ABSTRACT

A high capacity copy sheet supplying system for reproduction apparatus, in which a large and heavy stack of copy sheets may be much more easily and accurately loaded therein, by a sheet supplying container insertable into the sheet supply input. This container has sheet stack confining side walls, a bottom wall with plural spaced apertures, and a false bottom tray insert loosely overlying that bottom wall on which the stack of copy sheets is supported. Plural lift rods are operatively connecting with an elevator system to provide movement of the lift rods up through the apertures in the bottom wall of the sheet supplying container, to engage and lift the false bottom tray and the large and heavy stack of copy sheets supported thereon by engagement of the ends of the lift rods, so as to lift up the large stack of copy sheets from within the sheet supplying container into engagement with a fixed position sheet feeder, and then to automatically maintain feeding of sheets from the top of the stack by maintaining with the elevator system the level of the top of the stack until the sheets are depleted by the sheet feeder. The same container can be used for an output stacker. It also may have a contents viewing window.

15 Claims, 5 Drawing Sheets

HIGH CAPACITY AUTOMATIC SHEET INPUT SYSTEM FOR A REPRODUCTION APPARATUS

Figure 1:
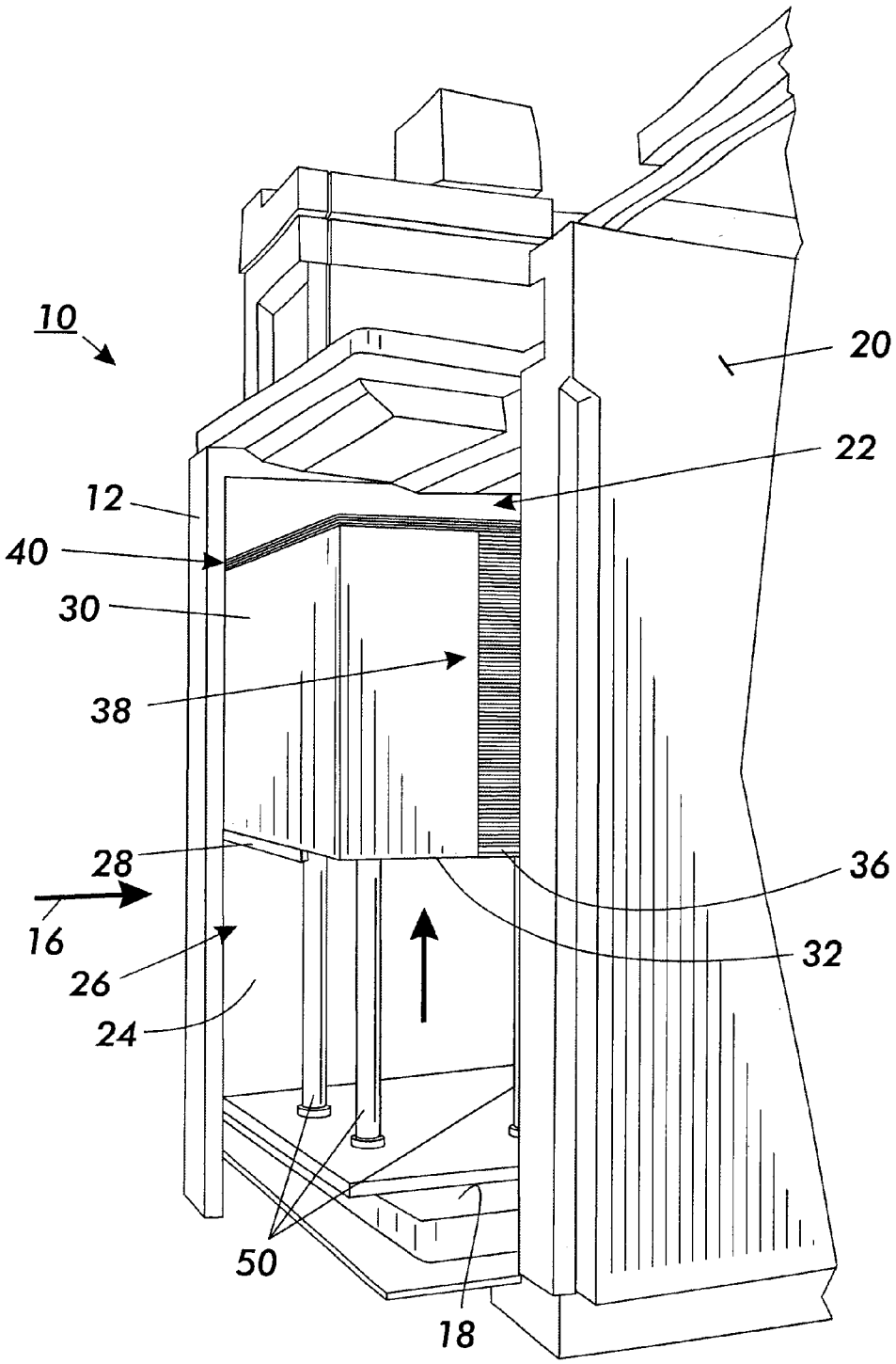

Disclosed is an improved copy or print sheets loading and feeding system for a reproduction apparatus. In particular, for improved ease and convenience of loading a large and heavy stack of a large number of sheets of paper or other image substrate material into a high sheet capacity input for a reproduction apparatus, for providing uninterrupted or continuous feeding of a large number of sheets.

In reproduction apparatus, such as xerographic and other printers or multifunction machines, it is increasingly important to provide easier, faster, more reliable and more automatic handling and feeding of the physical sheets to be printed with images, with reduced printing interruptions for sheet reloading, and the disclosed system is an improvement therein.

The disclosed system is particularly suitable for integration into or use with what is known in the art as a high capacity or "high-cap" feeder. It can enable uninterrupted feeding of the sheets to be printed from a large stack thereof, by automatic lifting of, and maintaining the vertical position of, the top of the stack with the sheet feeder which is feeding the sheets sequentially to the printer as the stack is depleted by that sheet feeding. It can provide high capacity sheet feeding without having to manually remove the sheets from their container and then manually restack the sheets into a "high-cap" feeder input.

Some examples of "high cap" sheet feeders, with or without elevator trays lifting and maintaining large stacks of copy sheets into engagement with a sheet feeder input to a copier or printer with various stack elevator systems, are disclosed in Xerox Corp. U.S. Pat. Nos. 4,436,406; 4,718,658; 5,152,520; and 5,328,167.

In the disclosed system a large, heavy, stack of sheets may be loaded directly into the printer sheet input while still held in their shipping and storage container, yet those sheets, or that novel container, does not have to be thereafter lifted or moved. Rather, the stack may be automatically lifted vertically up from inside that container towards the sheet feeder by a novel stack lifting system. As disclosed in the embodiment herein, that may be provided by supporting the entire stack of sheets on a liftable false bottom stack supporting tray, which tray may be lifted by lift rods extending upwardly through apertures in the bottom of the shipping and storage container.

U.S. Pat. No. 4,556,210 may also be of background interest, as to a large sheet stack receptacle loading system.

Other disclosed features include a reusable copy sheet shipping and storage container which can also be used as an output sheet stacker and transporter for the printed sheets.

Also, this container may have a transparent vertically extending side window showing the stack level therein, and/or showing any identifying or marking idicia on the edges of the sheets, before or after printing. After printing and finishing, this same window can also be used to view tape, colored banner sheets, or other print job or shared users jobs separator sheets, or other set separation indicia which is visible at the edges of sheets inside this container.

Thus, the disclosed container embodiment is especially suitable for use as a printed sheets output stacker and temporary removal, transport, and/or storage container for the sets of printed sheets. In particular, it can be effectively used with a system of output set temporary binding and edge identification, as described in U.S. Pat. No. 5,980,676, issued Nov. 9, 1999 to the same Murray O. Meetze, Jr., from allowed U.S. App. Ser. No. 08/128,929 (D/90136D). The published European Patent Office equivalent application is Number EP 0 547 788, published on Jun. 23, 1993. It describes and shows plural sheet print jobs with separating and edge identifying indicia such as individually bar coded removable tapes which would be readily visible through the container side window system of the disclosed embodiment here. That is, as described in that patent, small removable print job and/or printer user labeling and set-holding tapes extending around opposing edges of each distinct print job or printed document stacked into the subject exemplary container, with the bar codes or other indicia for each taped document or print job set of sheets being visible though the window in the side of the box.

A specific feature of the specific embodiment disclosed herein is to provide in a high capacity copy sheet supplying system for a reproduction apparatus, with a sheet feeder for feeding copy sheets into said reproduction apparatus, and with a sheet supply input into which a large and heavy stack of a large number of copy sheets may be loaded, and with an elevator system for lifting the stack of copy sheets in said sheet supply input into sheet feeding engagement between the top of said stack and said sheet feeder, and for maintaining the top of said stack in said sheet feeding engagement with said sheet feeder as said stack is depleted by said feeding of said copy sheets by said sheet feeder into said reproduction apparatus, the improvement in said high capacity copy sheet supplying system comprising: a sheet supplying container insertable into said sheet supply input of said high capacity sheet supplying system, said sheet supplying container having sheet stack confining side walls and a bottom wall with plural spaced apertures, a false bottom tray insert loosely overlying said bottom wall of said sheet supplying container, said large and heavy stack of copy sheets being supported on said false bottom tray insert in said sheet supplying container, plural spaced apart lift rods operatively connecting with said elevator mechanism for substantially vertical movement, said lift rods being respectively spaced in alignment with respect to said plural spaced apertures in said bottom wall of said sheet supplying container, said lift rods extending substantially parallel to one another and having rod ends in substantially the same plane, said plurality of spaced apart lift rods being movable by said elevator system to extend up through said plural spaced apertures in said bottom wall of said sheet supplying container to engage and lift said false bottom tray insert and said large and heavy stack of copy sheets supported thereon by lifting engagement of said rod ends of said lift rods with said false bottom tray insert, so as to lift said large and heavy stack of copy sheets relative to said sheet supplying container and into engagement with said sheet feeder.

Further specific features disclosed herein, individually or in combination, include those wherein said sheet supply input includes a supporting surface for said sheet supplying container and an input alignment system for said sheet supplying container for aligning said plural spaced apertures in said sheet supplying container with said plural spaced apart lift rods; and/or wherein said sheet supplying container has at least one said side wall with a vertical transparent window through which the height of said stack of copy sheets in said sheet supplying container is visible from outside of said sheet supplying container; and/or wherein said plural spaced lift rods comprises four such rods; and/or wherein said elevator system includes a sheet stacking elevator tray for manually stacking sheets thereon for feeding said sheets with said sheet feeder without said sheet supplying container; and/or wherein said sheet supplying container is a reusable container adapted to be alternatively placed at the output of a reproduction apparatus for the stacking therein of printed sheets outputted by said reproduction apparatus; and/or wherein said sheet supplying container has at least one said side wall with a vertical transparent window through which the edges of printed sheets in said sheet supplying container are visible from outside of said sheet supplying container; and/or a high capacity sheet supplying system for a reproduction apparatus with an input sheet feeder and a sheet supply input, said sheet supplying system comprising: a sheet supplying container which is insertable into said sheet supply input of said reproduction apparatus, said sheet supplying container having sheet stack confining side walls and having an apertured bottom wall, said sheet supplying container having a false bottom tray insert loosely overlying said bottom wall of said sheet supplying container, and a large and heavy stack of copy sheets supported on said false bottom tray insert in said sheet supplying container, said large and heavy stack of copy sheets being liftable out of said sheet supplying container into engagement with said input sheet feeder by mechanically lifting said false bottom tray insert within said sheet supplying container through said apertured bottom wall of said sheet supplying container; and/or wherein said sheet supplying container has enclosing side walls for maintaining single stack alignment of said large and heavy stack of copy sheets in said sheet supply input of said reproduction apparatus; and/or wherein at least one said enclosing side wall has a vertical transparent window through which one edge of said copy sheets within said sheet supplying container are externally visible; and/or an improved method of loading a tall stack of printing sheets into a high capacity printing sheets feeding input of a printer and maintaining the top of said tall stack of printing sheets in sheet feeding engagement with a sheet feeder for feeding said sheets to said printer, comprising: inserting a sheet stack transporting container holding said tall stack of printing sheets therein into said printing sheets feeding input of said printer without unloading said sheets from said container, said container having an apertured bottom, supporting said tall stack of printing sheets in said container on a false bottom tray insert, said false bottom tray insert being inside of said container and overlying an apertured bottom of said transporting container, and lifting and maintaining the top of said tall stack of printing sheets in said container in engagement with said sheet feeder with a lifting system inserted through at least some of said apertures in said apertured bottom of said container, said lifting system engaging and lifting said false bottom tray insert and thus lifting said tall stack of printing sheets supported thereon; and/or the improved method of loading a tall stack of printing sheets into a high capacity printing sheets feeding input of a printer and maintaining the top of said tall stack of printing sheets in sheet feeding engagement with a sheet feeder, further including maintaining said top of said tall stack of printing sheets at a level extending slightly above the top of said sheet stack transporting container by said lifting as said sheets are fed by said sheet feeder to said printer; and/or further including supporting said sheet stack transporting container on a fixed supporting surface while said false bottom tray insert and said tall stack of sheets supported thereon are being so lifted; and/or wherein said false bottom tray insert is automatically repeatedly lifted vertically as said sheets are fed by said sheet feeder to maintain the top of said stack at substantially the same vertical position relative to said sheet feeder; and/or wherein said lifting by said lifting system of said false bottom tray insert comprises commonly pushing a plurality of spaced apart parallel lifting rods up through said apertures in said bottom of said sheet stack transporting container into lifting engagement with said false bottom tray insert.

In the description herein the term "sheet" refers to a usually flimsy physical sheet of paper, plastic, or other suitable physical image substrate for being printed on, whether precut or initially web fed. As referring to a reproduction apparatus, such a sheet may be variously or alternatively referred to as a "copy sheet", "paper", "plain paper" (even though it may be partially pre-printed), "plain paper input" or just "input", before printing, which after printing may be variously referred to as a "print", "copy", "hardcopy" or "output". A "print job" is normally a set of related sheets, usually one or more collated copy sets, copied from a set of original document sheets or electronic document page images, from a particular user, or otherwise related. The term "document" was previously used in many cases to mean an "original" sheet being copied but now more typically is used broadly to encompass plural related pages of images, or a single page image, either electronic pages or pages on physical sheets. The terms "printer" or "reproduction apparatus" as used herein both broadly encompass various xerographic or other copiers, printers, or multifunction machines As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Figure 2:
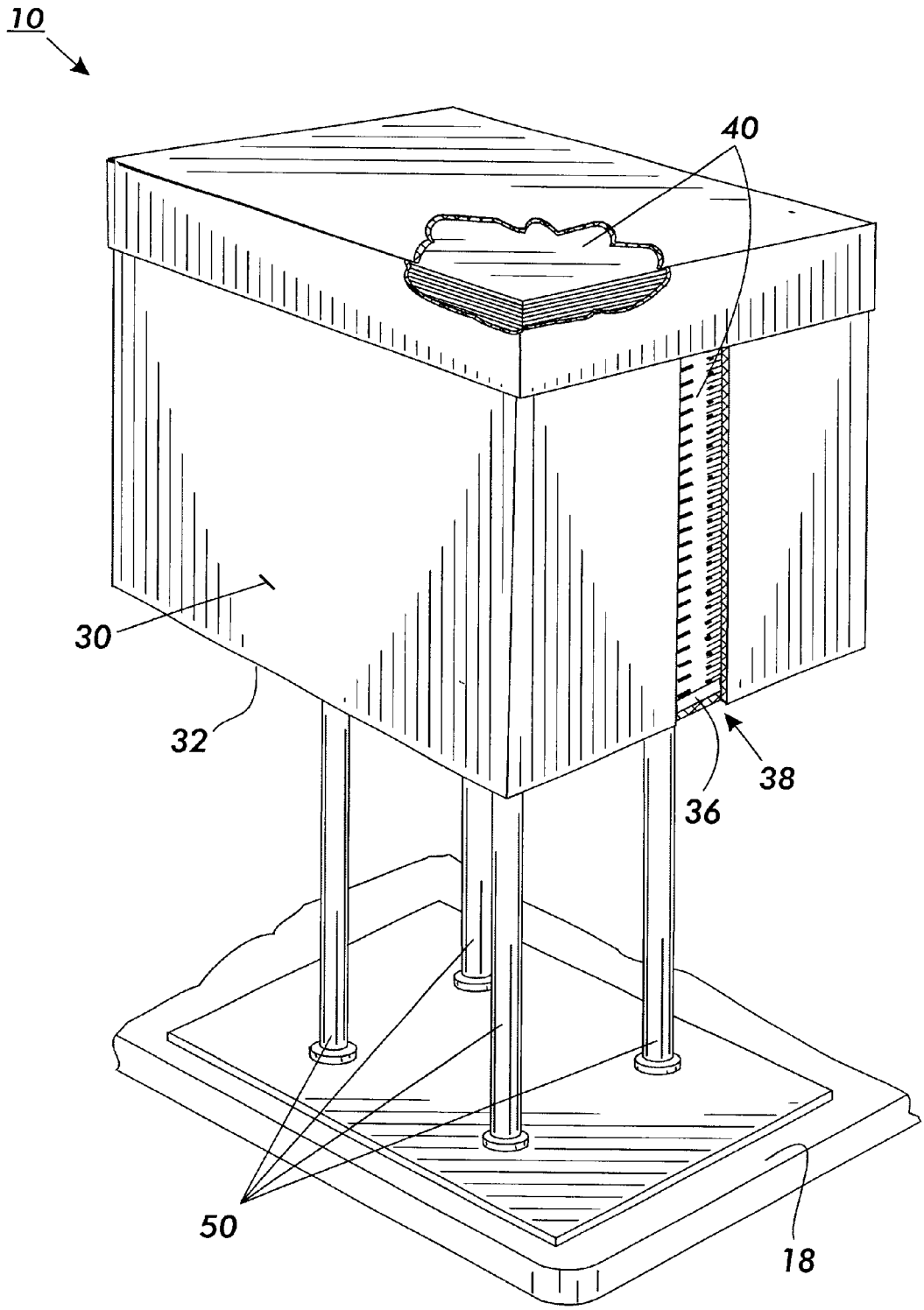
Figure 3:
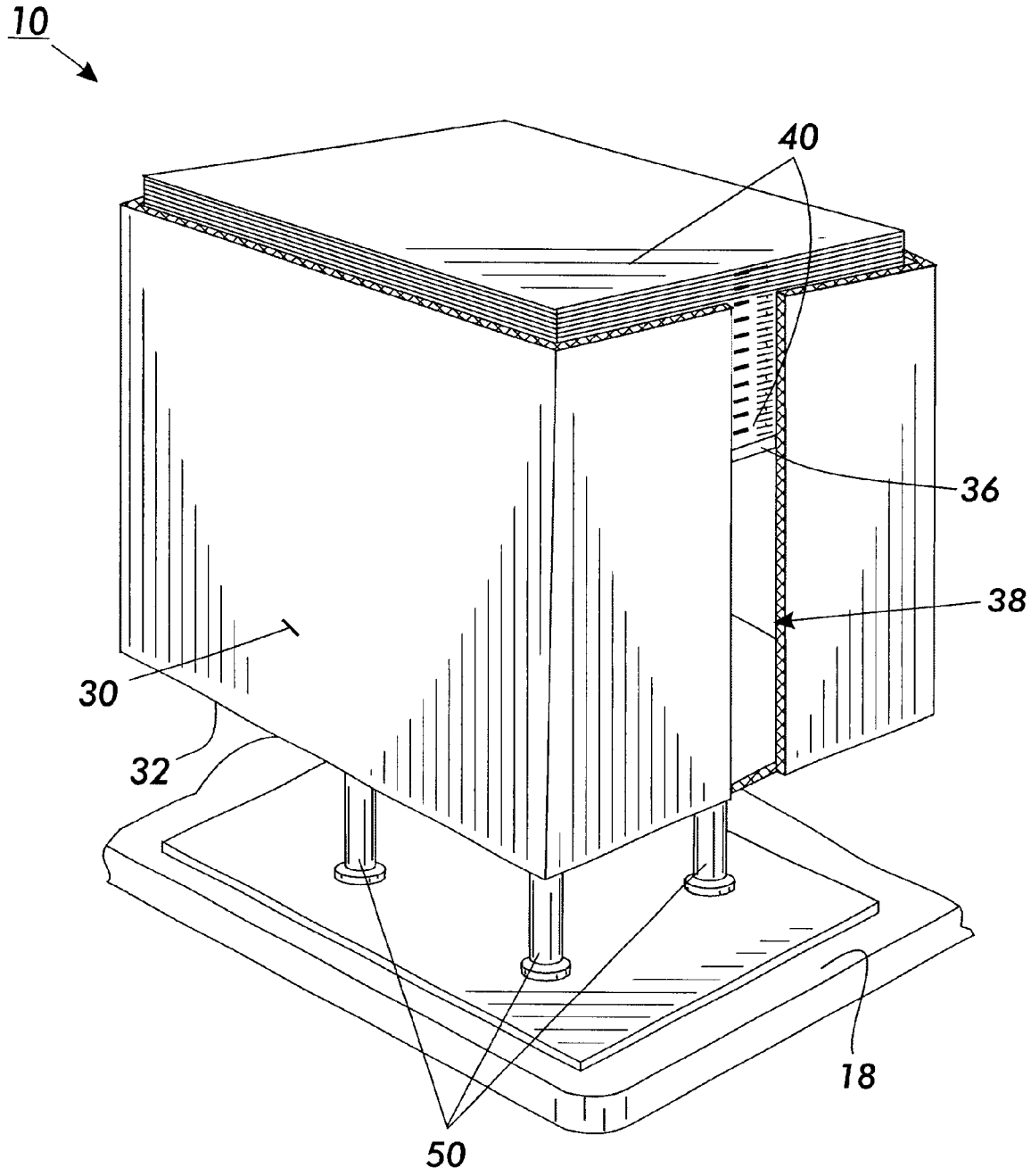
Figure 4:
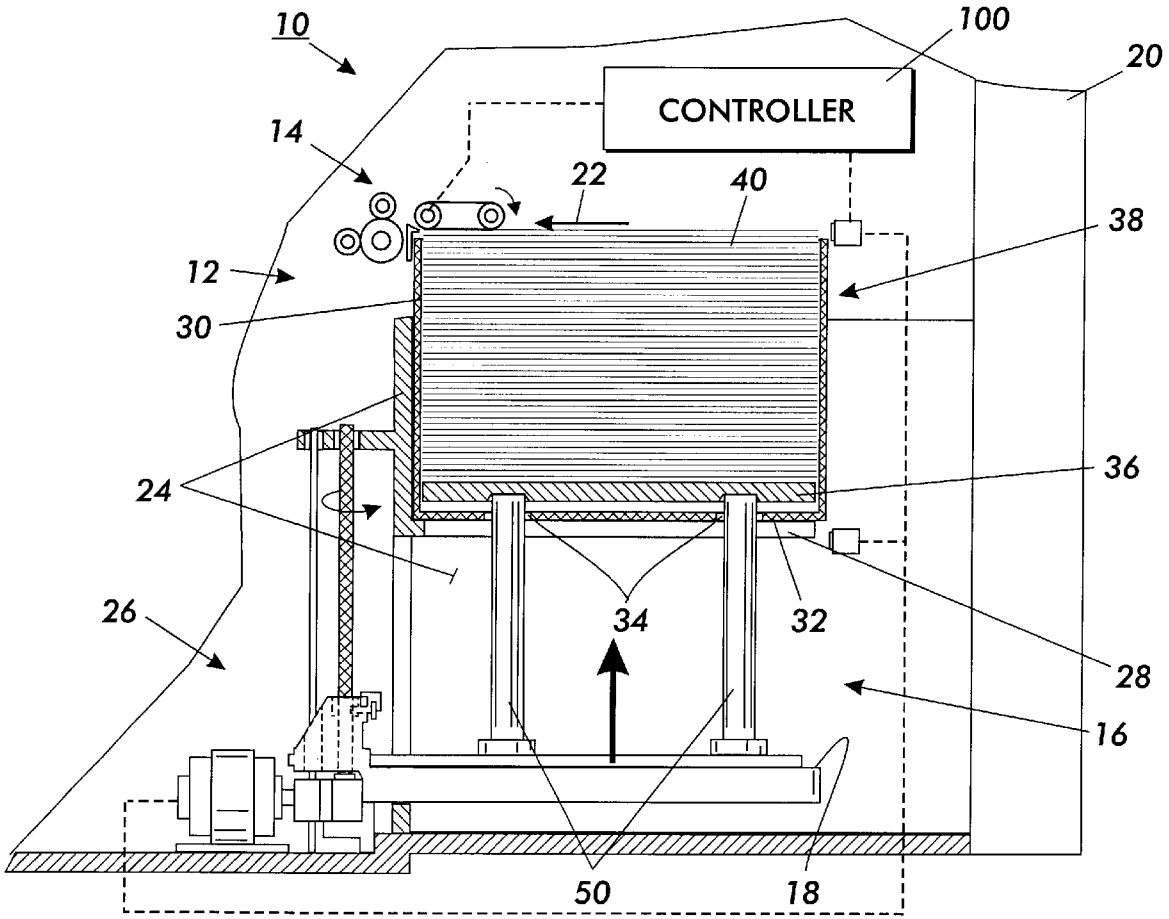
Figure 5:
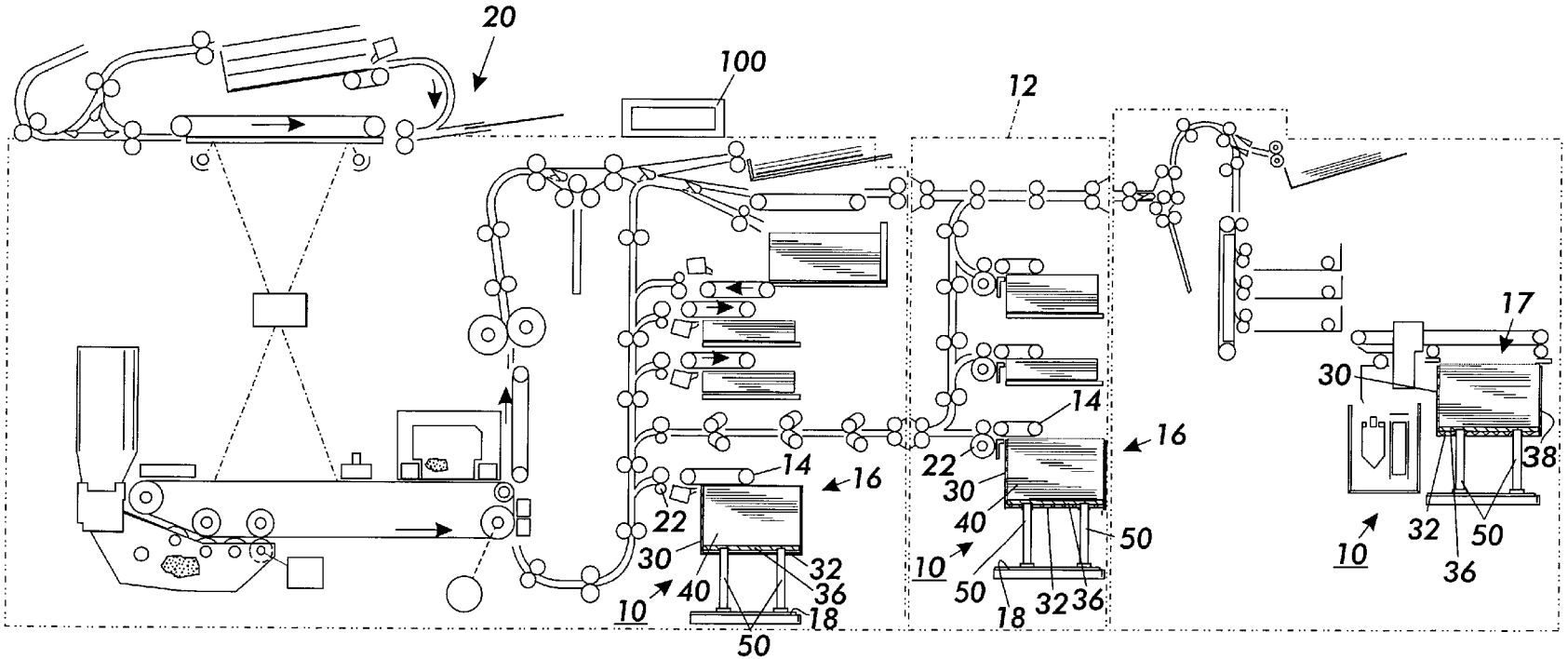

Various of the above-mentioned and further features and advantages will be apparent from the specific apparatus and its operation described in the example below, and the claims. Thus, the present invention will be better understood from this description of one specific embodiment, including the drawing figures (approximately to scale) wherein:

FIG. 1 is a frontal perspective view of one embodiment of a disclosed high capacity sheet loading and feeding system for the high capacity input portion of an otherwise conventional printer, incorporating aspects of the present invention;

FIG. 2 is a perspective view of a portion of the embodiment of FIG. 1, in particular an exemplary special sheet storage and transporting container per se with copy sheets stacked therein plus one example of part of the associated stack lifting for sheet feeding system for which said container operatively cooperates, shown in a position as the container is being initially loaded into a printer input, in this particular embodiment;

FIG. 3 is a view otherwise identical to FIG. 2 but showing the relative positions of those same components after said initial loading, showing the conventional container box top removed and the top of the stack shown lifted up and slightly extending above the top of the open container for feeding sheets sequentially therefrom, while the remainder of the stack is still inside the container which is holding the stack in its properly stacked position (in both FIGS. 2 and 3, optional edge markings on the edges of the sheets are also illustrated);

FIG. 4 is a partially rear cross-sectional view of the embodiment of FIG. 1; and FIG. 5 schematically shows an example of an otherwise well known reproduction and sheet supply system containing three of the embodiments of FIGS. 1–4, one of which is integral the printer one of which is in an attached modular additional high capacity sheet supply unit, and a third being used in a connecting on-line finisher unit as a removable sheet output stacker container for multiple printed and taped sheet sets.

Referring to the Figures, there is shown in the disclosed embodiment a system 10, by which an otherwise conventional reproduction apparatus (printer 20) can be directly loaded with a special container or box 30, for improved loading and automatic feeding of a large stack of copy sheets 40 therefrom, with reduced operator effort, greater convenience, and improved stack registration control. This disclosed high capacity sheet feeding system 10 allows the copy sheets to be fed directly into the reproduction apparatus 20 for printing from a special supply container, such as 30, instead of requiring the machine 20 user or operator to manually unstack, unwrap and load plural reams of copy sheets into a conventional high capacity feeder. That is needed in order to provide a large (tall) stack of sheets sufficient to allow longer printing runs and/or larger print jobs without printing interruptions for reloading more copy sheets. For example, the particular exemplary sheet storage and transporting box or other container illustrated here can contain five or more reams of standard "4024" Xerox Corp. copy paper in a stack of about 25.4 cm (ten inches) high. Furthermore, manual sheet re-stacking errors (offset or skewed portions of a stack), which can lead to sheet feeding errors, are also avoided, because the stack remains within, and remains registered by, the four stack-confining side walls of the container 30 except for a minor upper portion of the stack 40 which extends above the top edges of those side walls of the opened container 30 for sheet feeding.

The disclosed high capacity sheet feeding system 10 may be part of, and compatible with, an otherwise existing or conventional high capacity sheet feeding module 12, integral the printer 20. The module 12, as is well known, may be integral to various reproduction machines or an add-on accessory thereto. The module 12 here conventionally provides a top sheet feeder 14 for the copy sheet input 22 to a printer 20. The top sheet feeder 14 of the module 12 is overlying an otherwise conventional sheet stacking input 16 comprising an otherwise conventional vertically repositionable elevator tray 18 (previously used as a loading shelf for stacking the copy sheet thereon, but not in this embodiment).

As shown for example in FIG. 4 (or the cited references), the elevator tray 18 may be vertically elevated towards the paper feeder 14 (here, to lift and maintain the top of the stack 40 thereagainst with lifting rods 50, as will be described). The elevator tray 18 may so moved by various known lift systems. Here the lift system 26 comprises by a motor and gear box driven lead screw and guides system, controlled in a known manner by a controller 100. Connecting control sensors, as also shown in FIG. 4, may also be provided, and/or a pivoting or other engagement switch may be provided in the sheet feeder 14 itself. These controls act to stop the lifting movement of the lift system 26 once the top of the sheet stack 40 is moved up into engagement with the top sheet feeder 14, and to restart and further lift up the top of the stack 40 as sheets are depleted therefrom by being fed off.

Fixed alignment surfaces 24 or guide members are also provided as part of the stacking input 16 so that as a copy sheets supply box 30 is inserted into the stacking input 16, the box 30 is aligned on both axes. Thus, the inserted box 30 is automatically correctly aligned under the sheet feeder 14, and is also aligned over the positions of the stack lifting rods 50 (to be described), which rods 50 are preferably in fixed positions relative to the elevator tray 18, as shown, or integral therewith, or in a rod unit which replaces the elevator tray 18 and is connected to the lift system 26 instead of the tray 18.

Heretofore, the copy sheets for the input 16 of the high cap module 12 would normally have had to have been manually unloaded from a prior paper supply container and unwrapped, one or more reams at time, and then manually placed onto the elevator tray 18, one or more reams at a time, neatly manually restacked in vertical alignment with one another, every time more copy sheets were needed at that sheet supply input 16. That is, several manual unpacking, unwrapping, and restacking steps. Uneven restacking could result in missfeeding.

With the disclosed high capacity sheet feeding system 10, the conventional high cap feeder module 12 may still conventional feed copy sheets sequentially from the top of a stack of sheets at the sheet input 16 with the existing, conventional, sheet feeder 14 to the connecting conventional printer 20 sheet input 22, without any required modifications or additional cost. Yet, with the disclosed high capacity sheet feeding system 10, the high cap feeder module 12 can continuously feed, without interruptions, plural reams of copy paper, in a single stack of copy sheets 40, without operator intervention. In the disclosed system 10, the copy sheets feed directly from the copy sheet transporting and supply box or container 30 to the sheet feeder 14 to feed the printer 20, without any of the above-described manual unpacking, unwrapping, and restacking steps, as will be described.

Simply removing a box top (as shown in FIG. 2) from the copy sheet supply box 30 and placing that opened box 30 in the sheet input 16, as shown in FIG. 3 and FIG. 4, is the only operator manual operation required to load a large stack 40 of copy sheets into the input 16 of the printer 20. The box 30 top may be conventional, as shown in FIG. 2. It may be simply lifted off, preferably after a strip of sealing tape around the edges of the box top is removed, as in a conventional paper supply box for xerographic copy paper.

The operator simply loads the full paper supply box 30 into the stacking input 16, overlying the tops of the rods 50. In this embodiment of FIG. 4 the bottom 32 of the box 30 may be loaded by sliding it onto a fixed U-shaped or other box bottom supporting surface member 28. The loading surface 28 is spaced above the lowest position of the elevator tray 18 by at least the length of the rods 50 in this example, so that the rods 50 do not interfere with the horizontal loading movement and lateral alignment of the box 30.

The bottom 32 of the box 30 itself has a plurality of holes, openings or apertures 34, here four of them, to allow the subsequent entry therethrough of a corresponding (or lesser) number of lift rods 50. As noted, the rods 50 here are supported by or integral with the elevator tray or prior loading shelf 18 of the high capacity feeder module 12, or otherwise connected to be lifted by the lift system 26.

Inside the box 30, overlying the holes 34, is a rigid tray or false bottom 36 which is overlying, and initially resting on, the bottom 32 of the box, and is underlying all of the copy sheets in the box. That is, the stack 40 rests on, and is supported by, the tray or false bottom 36.

As the four lift rods 50, all of the same height, are commonly lifted up together through the holes 34 in the bottom 32 of the box 30 by the lift system 26, the tops of these lift rods 50 engage and lift this unapertured (at least in the same areas) false bottom 36 and thereby push up the entire stack of paper within the supply box 30 up and out of the box and into engagement with the high capacity stack feeder 14. The false bottom 36 is loose in the bottom of the box 30, by having somewhat smaller dimensions than the interior dimensions of the box 30.

The sheet feeder 14 is oriented above the box 30 loading position in a position to feed the sheets directly from their initial stack orientation in the inserted supply box 30. As the sheets feed out, the four lift bars 50 automatically integrally move up to compensate for what would otherwise be a reduction in the stack height position relative to the feeder 14, thus allowing the feeder 14 to remain in substantially the same position, for feeding the entire stack 40. (As is well known, the feeder 14 may be pivotal for partial adjustment to the level of the top of the stack from which it is feeding.)

The tray or false bottom 36 may also provide a seal for the holes 34 in the bottom 32 of the stacking box 30 before it is placed in use. The false bottom 36 may be, for example, heavy cardboard with a waterproof coating, or plastic, providing a sufficient seal to protect the paper inside the box before it is used. However, the holes 34 could also be covered on the outside or inside of the box bottom 32 with a tearable tape which could be sufficiently thin to be easily removed or ruptured automatically by the lift bars 50 penetrating through the holes 34. The false bottom 36 is preferably a sufficiently thick and rigid cardboard or rigid plastic flat panel or the like that is strong enough to hold on top of it the weight of all of the paper and also stay relatively flat even though supported on only a "4-point suspension" on the tops of the four lift rods 50. The tray or false bottom 36 may be of the same or different material as the box 30 itself. It may be a simple planar sheet, or have bottom dimples or recesses engaged by the ends of the rods 50, as shown in FIG. 4.

As one example, the stack lifting bars or rods 50 would need to be only approximately 30 cm (12 inches) high for a box with an approximately 25 cm (ten inch) high stack, allowing approximately 5 cm (2 inches) for the travel and gradual lifting up of all of the paper in the box 30, to empty the box 30, as the top sheets are fed off the exposed top of the stack 40 by engagement with the sheet feeder 14. The number of lift rods 50 could, of course, be increased or decreased from the 4 shown here, if desired or necessary. Four rod ends provides stable vertical lifting with reasonably distributed forces, thus not requiring a particularly thick or strong stack supporting tray or false bottom 36. The rods 50 may be simple vertical rods of plastic or other suitable material, such as cylindrical or square tubes or channels on the order of approximately 2 cm (¾ inches) in diameter or greater, or even L or I beams of approximately those dimensions per side.

Various other alternative elevator and elevator tray mechanisms known to existing high capacity feeder trays, or copy sheet output trays, can be utilized with the lift rods 50 or other versions thereof, and need not be described herein. For example, as an alternative to what is shown here, the elevator mechanism could connect only with the rods 50, and a fixed position but apertured box 30 loading surface member could be provided, such that in their lowest position the tops of the rods 50 could be approximately flush with that generally horizontal loading surface on which the supply box 30 is loaded. The rods 50 would then elevate up through the apertures in the loading surface and the box bottom 32 resting thereon to engage the stack supporting tray 36 within the box 30. In another alternative the rods 50 can be integral the elevatable loading shelf 18 rather than being mounted to a base plate as a separate unit which is mounted on that shelf 18, as shown.

In another alternative, a dual mode high cap feeder can be provided, so that it can be used with or without the disclosed special supply box. The elevator tray under the box can be conventionally designed to unhook or unlatch from the elevator posts if the special supply box is present, or be latched to the posts to hold, lift and feed a manually loaded stack of paper thereon without the special box.

As noted above, lead-in guides or baffles 24 in the module 12 can be provided to ensure that the box 30 is properly positioned and aligned within the copy sheet input 16—with the box holes 34 aligned over the tops of the lift rods 50, thereby ensuring that the rods 50 are in position to move up through those holes 34 in the bottom of the box to engage the tray or false bottom 36, as particularly shown in FIG. 4. The holes 34 may of course be substantially larger in diameter than the diameter of the lift rods 50, to provide non-critical alignment.

Furthermore, the copy paper supply boxes 30 can be reusable. When a copy sheet supply box 30 is (automatically) emptied, as described herein, it can be used at the output end of the printer 20, as shown in FIG. 5, as a output stacker and transport container for the finished printed sheet sets.

The box 30 may also be provided as shown with a vertical viewing window 38 in a side wall of the box 30 which allows the operator to view the level of paper remaining to be fed before another reloading operation is required. When a box 30 is being alternatively used as a output stacker, the same vertical viewing window 38 can then allow the operator to view the level or fullness of the stack within the box. The transparent window 38 may be provided by a Mylar™ or other clear plastic strip sealed to each side of the window slot in the side of the box 30. This viewing window 38 may have a removable tape protective cover which can be removed when the box 30 is to be used.

It will be appreciated from this teaching that various alternatives, modifications, variations or improvements therein may be made by those skilled in the art, which are intended to be encompassed by the following claims.

What is claimed is:

1. In a high capacity copy sheet supplying system for a reproduction apparatus, with a sheet feeder for feeding copy sheets into said reproduction apparatus, and with a sheet supply input into which a multi-ream stack of a large number of copy sheets may be loaded, and with an elevator system for lifting the stack of copy sheets in said sheet supply input into sheet feeding engagement between the top of said stack and said sheet feeder, and for maintaining the top of said stack in said sheet feeding engagement with said sheet feeder as said stack is depleted by said feeding of said copy sheets by said sheet feeder into said reproduction apparatus, the improvement in said high capacity copy sheet supplying system comprising:

a sheet supplying container insertable into said sheet supply input of said high capacity sheet supplying system, said sheet supplying container having sheet stack confining side walls and a bottom wall with plural spaced apertures, a false bottom tray insert loosely overlying said bottom wall of said sheet supplying container, said stack of copy sheets being supported on said false bottom tray insert in said sheet supplying container, plural spaced apart lift rods operatively connecting with said elevator mechanism for substantially vertical movement, said lift rods being respectively spaced in alignment with respect to said plural spaced apertures in said bottom wall of said sheet supplying container, said lift rods extending substantially parallel to one another and having rod ends in substantially the same plane, said lift rods extending longer than said sheet stack confining side walls, said plurality of spaced apart lift rods being movable by said elevator system to extend up through said plural spaced apertures in said bottom wall of said sheet supplying container to engage and lift said false bottom tray insert and said stack of copy sheets supported thereon by lifting engagement of said rod ends of said lift rods with said false bottom tray insert, so as to vertically lift said stack of copy sheets relative to said sheet supplying container above said sheet stack confining side walls and into engagement with said sheet feeder.

2. The high capacity copy sheet supplying system of claim 1, wherein said sheet supply input includes a supporting surface for said sheet supplying container and an input alignment system for said sheet supplying container for aligning said plural spaced apertures in said sheet supplying container with said plural spaced apart lift rods.

3. The high capacity copy sheet supplying system of claim 1, wherein said sheet supplying container has at least one said side wall with a vertical transparent window through which the height of said stack of copy sheets in said sheet supplying container is visible from outside of said sheet supplying container.

4. The high capacity copy sheet supplying system of claim 1, wherein said plural spaced lift rods comprises four such rods.

5. The high capacity copy sheet supplying system of claim 1, wherein said elevator system includes a sheet stacking elevator tray for manually stacking sheets thereon for feeding said sheets with said sheet feeder without said sheet supplying container.

6. The high capacity copy sheet supplying system of claim 1, wherein said sheet supplying container is a reusable container adapted to be alternatively placed at the output of a reproduction apparatus for the stacking therein of printed sheets outputted by said reproduction apparatus.

7. The high capacity copy sheet supplying system of claim 6, wherein said sheet supplying container has at least one said side wall with a vertical transparent window through which the edges of printed sheets in said sheet supplying container are visible from outside of said sheet supplying container.

8. An improved method of loading a multi-ream stack of printing sheets into a high capacity printing sheets feeding input of a printer and maintaining the top of said multi-ream stack of printing sheets in sheet feeding engagement with a sheet feeder for feeding said sheets to said printer, comprising:

unsealing and inserting a sealed sheet stack shipping container holding said multi-ream stack of printing sheets therein into said printing sheets feeding input of said printer without unloading said sheets from said container, said container having an multi-apertured bottom and a false bottom tray insert supporting said multi-ream stack of printing sheets in said container on said false bottom tray insert, said false bottom tray insert being inside of said container and overlying said multi-apertured bottom of said shipping container, and lifting and maintaining the top of said multi-ream stack of printing sheets in said shipping container in engagement with said sheet feeder with an automatic lifting system comprising a an elevator system operatively engaging a plurality of spaced apart elongated lifting rods inserted through at least some of said apertures in said multi-apertured bottom of said shipping container, said lifting system engaging, supporting, and lifting said false bottom tray insert to lift at least a portion of said multi-ream stack of printing sheets supported thereon up above said container for said engagement with said sheet feeder.

9. The improved method of loading a multi-ream stack of printing sheets into a high capacity printing sheets feeding input of a printer and maintaining the top of said multi-ream stack of printing sheets in sheet feeding engagement with a sheet feeder of claim 8, further including maintaining said top of said multi-ream stack of printing sheets at a level extending slightly above the top of said sheet stack transporting container as said sheets are fed by said sheet feeder to said printer.

10. The improved method of loading a multi-ream stack of printing sheets into a high capacity printing sheets feeding input of a printer and maintaining the top of said stack of printing sheets in sheet feeding engagement with a sheet feeder of claim 8, further including supporting said sheet stack transporting container on a fixed supporting surface while said false bottom tray insert and said tall stack of sheets supported thereon are being so lifted.

11. The improved method of loading a multi-ream stack of printing sheets into a high capacity printing sheets feeding input of a printer and maintaining the top of said stack of printing sheets in sheet feeding engagement with a sheet feeder of claim 8, wherein said false bottom tray insert is automatically repeatedly lifted vertically as said sheets are fed by said sheet feeder to maintain the top of said stack at substantially the same vertical position relative to said sheet feeder.

12. The improved method of loading a multi-ream stack of printing sheets into a high capacity printing sheets feeding input of a printer and maintaining the top of said stack of printing sheets in sheet feeding engagement with a sheet feeder of claim 8, wherein said lifting by said lifting system of said false bottom tray insert comprises commonly pushing a plurality of spaced apart parallel lifting rods up through said apertures in said bottom of said sheet stack transporting container into lifting engagement with said false bottom tray insert.

13. The high capacity copy sheet supplying system of claim 1, wherein said sheet supplying container is a fully enclosable cardboard shipping container for shipping protection of said multi-ream stack of copy sheets therein.

14. The high capacity copy sheet supplying system of claim 13, wherein said sheet supplying container is adapted to be reusable as a printed sheets stacking container placed at the printed sheets output of said reproduction apparatus for the stacking therein of printed sheets outputted by said reproduction apparatus.

15. The improved method of loading a multi-ream stack of copy sheets of claim 9, further comprising removing said sheet stack transporting container from said printing sheets feeding input of said printer after all of said printing sheets have been fed from said container and placing said container at the printed sheets output of said printer.

* * * * *